US010820758B1

(12) United States Patent
Smith

(10) Patent No.: US 10,820,758 B1
(45) Date of Patent: Nov. 3, 2020

(54) ADJUSTABLE UPRIGHT STANDING SOAP DISH

(71) Applicant: Tijuana Smith, Hinsdale, IL (US)

(72) Inventor: Tijuana Smith, Hinsdale, IL (US)

( * ) Notice: Subject to any disclaimer, the term of this patent is extended or adjusted under 35 U.S.C. 154(b) by 103 days.

(21) Appl. No.: 15/677,766

(22) Filed: Aug. 15, 2017

(51) Int. Cl.
*A47K 5/05* (2006.01)

(52) U.S. Cl.
CPC ..... *A47K 5/05* (2013.01)

(58) Field of Classification Search
CPC ..... A47K 5/02
See application file for complete search history.

(56) References Cited

U.S. PATENT DOCUMENTS 2,908,995 A * 10/1959 Seamon ..... A47K 5/02 206/77.1
2,932,119 A * 4/1960 Borah ..... A47K 5/02 248/346.11
3,318,454 A * 5/1967 Donlin ..... A47B 57/585 211/43
4,203,568 A * 5/1980 Daugherty ..... A47K 5/02 211/85.12
4,909,384 A * 3/1990 About ..... B65D 5/48024 206/561
5,941,376 A * 8/1999 Liggett ..... A47K 5/02 206/550

* cited by examiner

*Primary Examiner* — Sarah B McPartlin

(57) ABSTRACT

The present invention comprises an adjustable hosting device with a holder/brackets for soap that rest on an oval designed dish and allows the soap to stand and never touch the bottom of the soap dish. The hosting device is configured in different sizes to accommodate different shapes and molds of soap.

17 Claims, 9 Drawing Sheets

ADJUSTABLE UPRIGHT STANDING SOAP DISH

FIELD OF THE INVENTION

The present invention relates to soap dishes used to hold soap in between uses by the end user. More specifically, the invention relates to an adjustable detachable holding device that fits into a soap dish made to fit various soap sizes but particularly designed for handmade soaps which are larger than and shaped differently that soaps sold in department stores.

BACKGROUND

With the increase among consumers for natural products, handmade soap makers are experiencing an increase in demand for their products. Seeing that handmade soaps are not sold in grocery store chains or department stores, packing options are limited and which has created a challenge for finding the right packaging or storage for handmade soap products.

Handmade soap makers have either resorted to making their own packaging or just wrapping it in regular paper. In addition to that, the soap doesn't fit very well into the traditional soap cases/dishes sold in stores. They are either stored in loofah soap pouches or wrapped up in paper or plastic. This decreases the amount of uses a customer will get out of that soap because the soap needs air to keep it from dissolving or melting away. Soap cases/dishes on the market are made to have the soap lay on the dish so in between washes, the water drains from the soap and the soap is laying in the bacteria from the water and it is dissolving from the water it is laying in. None of the soap dishes provide a way for the soap to be able to stand instead of lay on the dish and none of them have anything that prevents the soap for touching the dish.

Therefore, a need exist in the field for a hosting apparatus that handmade soap will fit into and position the soap to be in a standing instead of laying position on a dish shaped with an oval bottom so that the soap never touches the bottom of the dish where the water from use of the soap drains into. A further need exist for this apparatus to be adjustable so that as the soap is used and it decreases in size, the apparatus can still hold it in place by being able to adjust the depth. Finally, there is also a need for the configuration of additional apparatuses to accommodate the dimensions of other soap molds and sizes.

BRIEF SUMMARY OF THE INVENTION

The present invention comprises an adjustable hosting device with a holder/brackets for soap that rest on an oval designed dish and allows the soap to stand and never touch the bottom of the soap dish. The hosting device is configured in different sizes to accommodate different shapes and molds of soap.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION OF THE INVENTION

The terminology used herein is for the purpose of describing particular embodiments only and is not intended to be limiting of the invention. As used herein, the term "and/or" includes any or all combinations of one or more of the associated listed terms. As used herein, the singular forms "a," "an," and "the" are intended to include the plural forms as well as the singular forms, unless the context clearly indicates otherwise. It will be further understood the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

New soap hosting devices, apparatuses, and methods for positioning soap in a standing position on top of a dish are discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention, and is not intended to limit the invention to the specific embodiments illustrated by the figures or description below.

An upright standing soap hosting device with a holder for handmade shaped soap comprising a back support 300 (also known as a back arm) and a front arm front support 200 (also known as a front aim) resting on a soap dish/case 100 (also known as soap dish). The soap hosting device made to hold handmade shaped soap in a standing position. The back support 300 having a bracket 302. The front support 200 attaches to the back support 300.

Figure 1A:
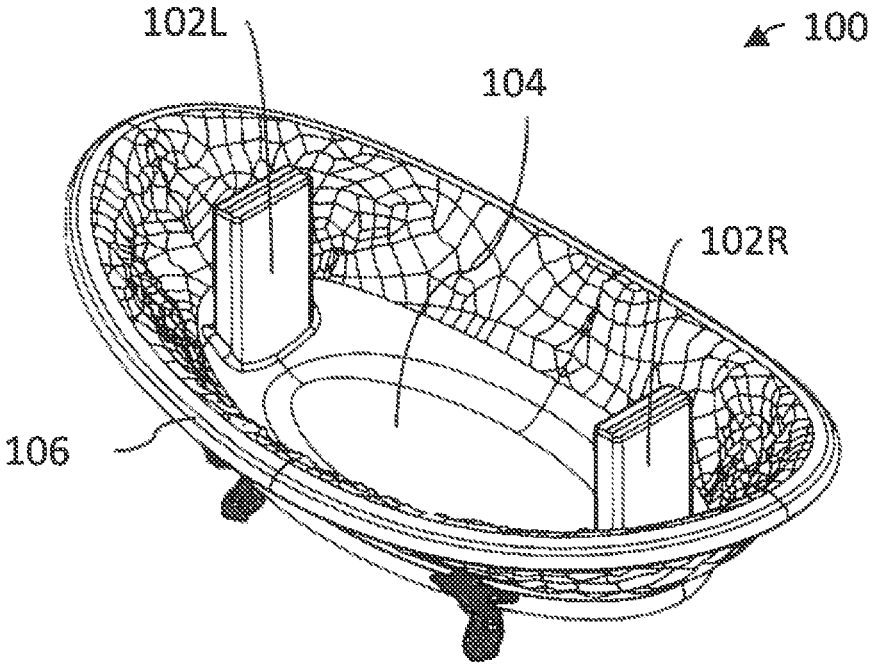
FIG. 1A depicts a perspective view, FIG. 1B a front and rear view, FIG. 1C a side view, FIG. 1D a top view, and FIG. 1E a bottom view of one example of a dish with ring and legs of an adjustable upright standing soap dish device according to various embodiments of the present invention.
Figure 1B:
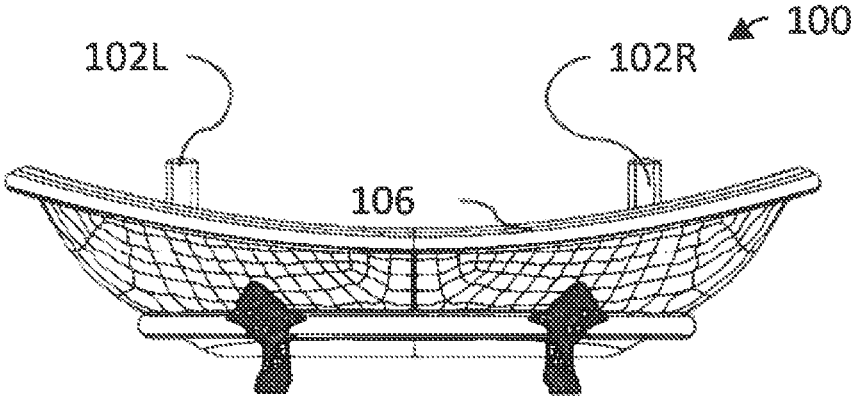
Figure 1C:
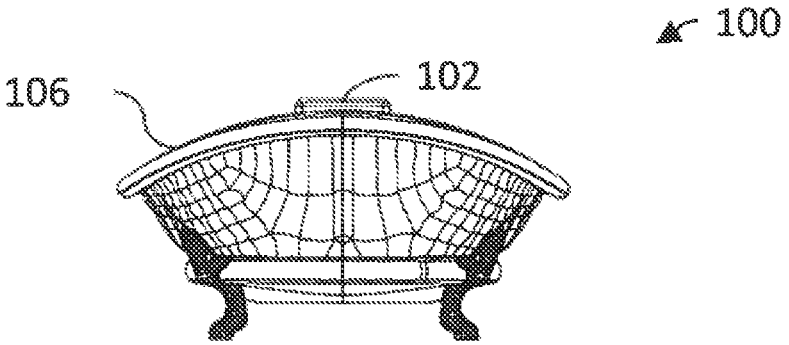
Figure 1D:
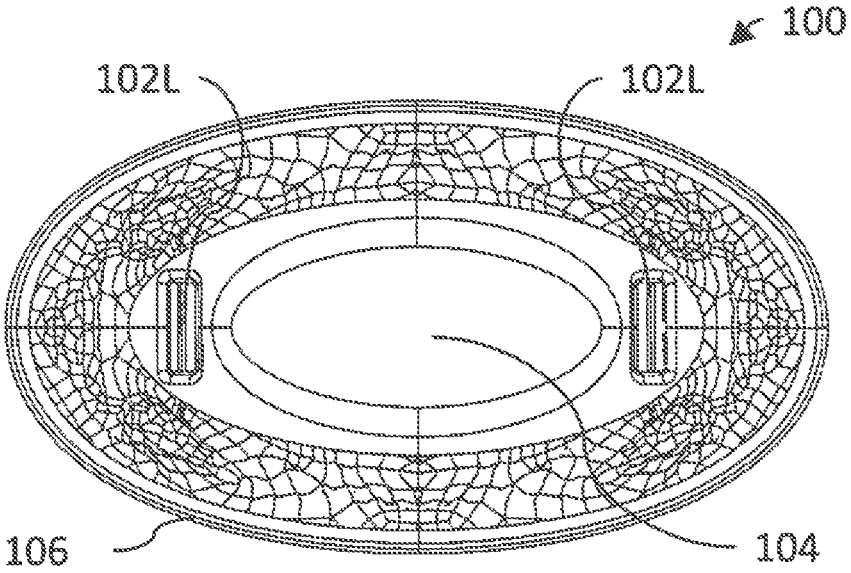
Figure 1E:
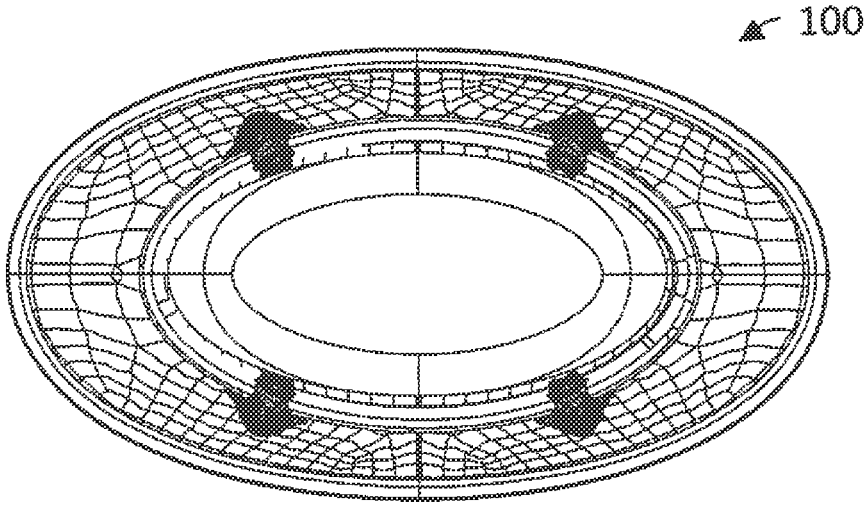
Figure 2A:
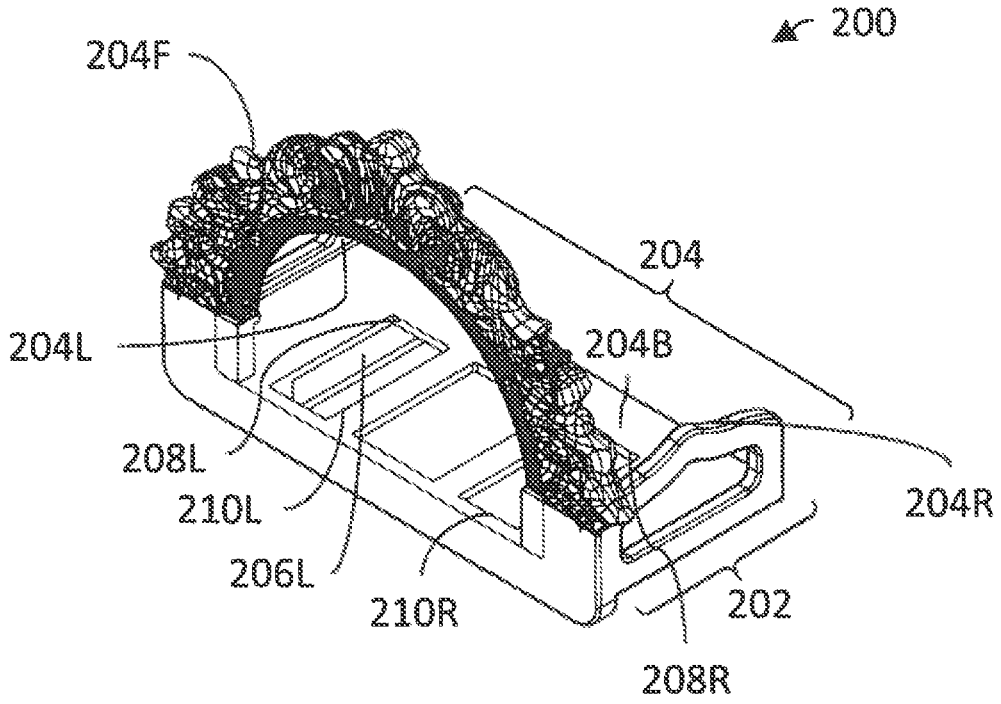
FIG. 2A illustrates a perspective view FIG. 2B a front view, FIG. 2C a right side view, FIG. 2D a top view, and FIG. 2E a bottom view of one example of a front support of an adjustable upright standing soap dish device according to various embodiments described herein.
Figure 2B:
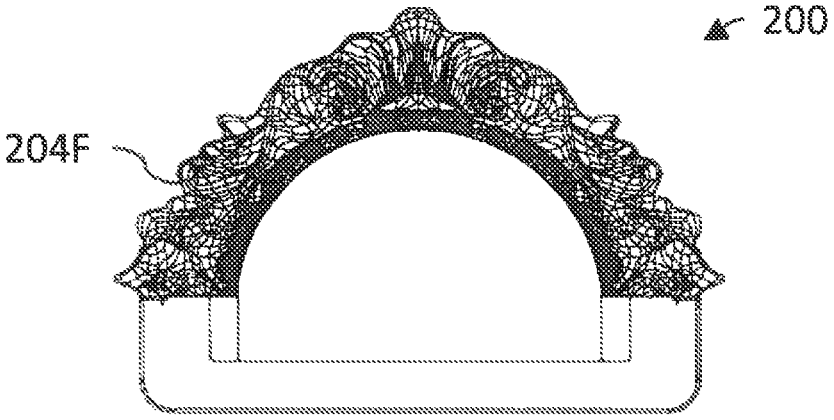
Figure 2C:
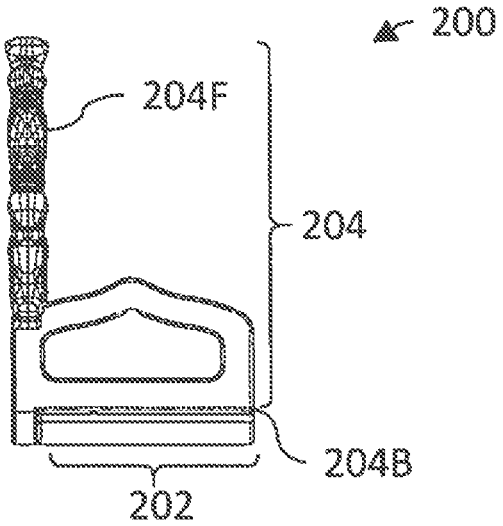
Figure 2D:
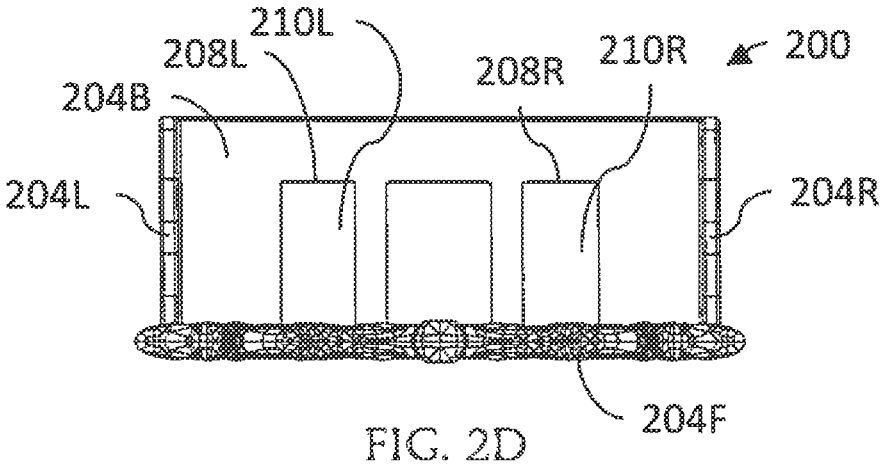
Figure 2E:
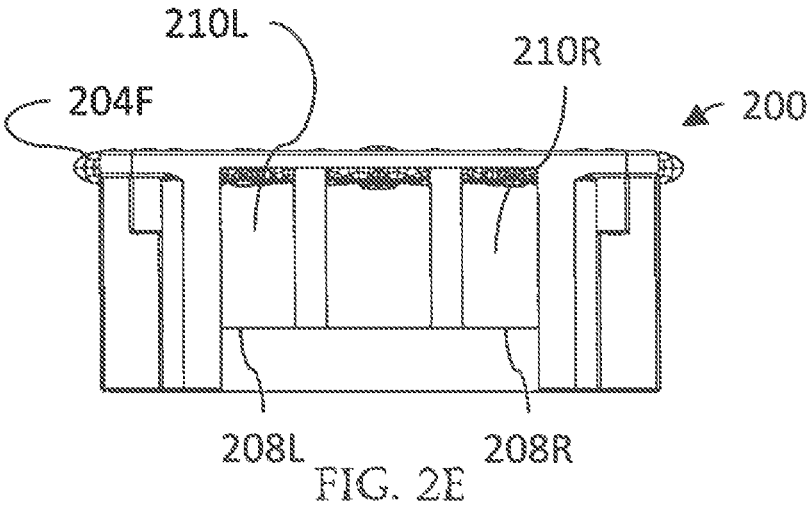
Figure 3A:
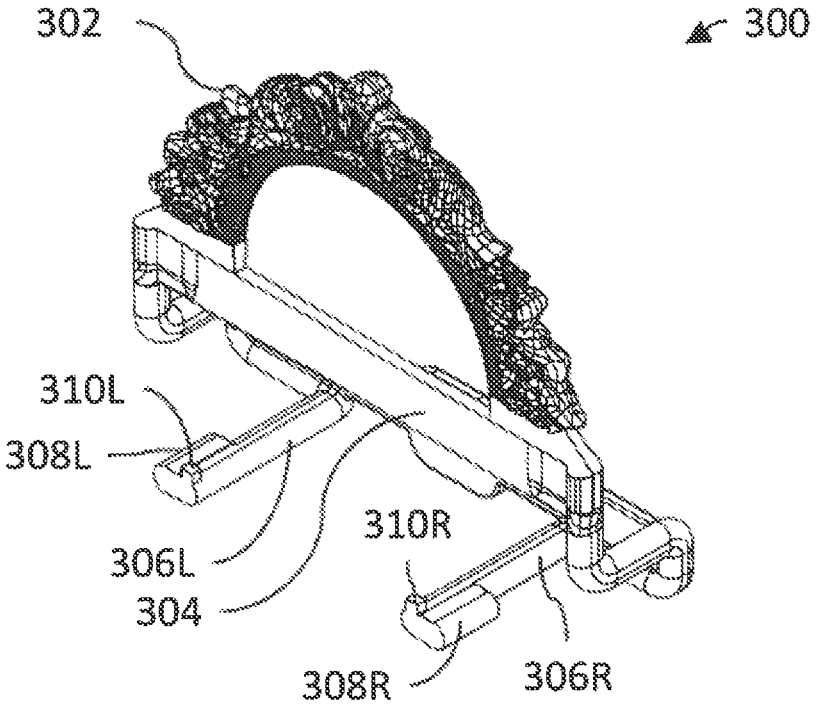
FIG. 3A shows a perspective view FIG. 3B a front view, FIG. 3C a right side view, FIG. 3D a top view, and FIG. 3E a bottom view of an example back support of an adjustable upright standing soap dish device according to various embodiments described herein.
Figure 3B:
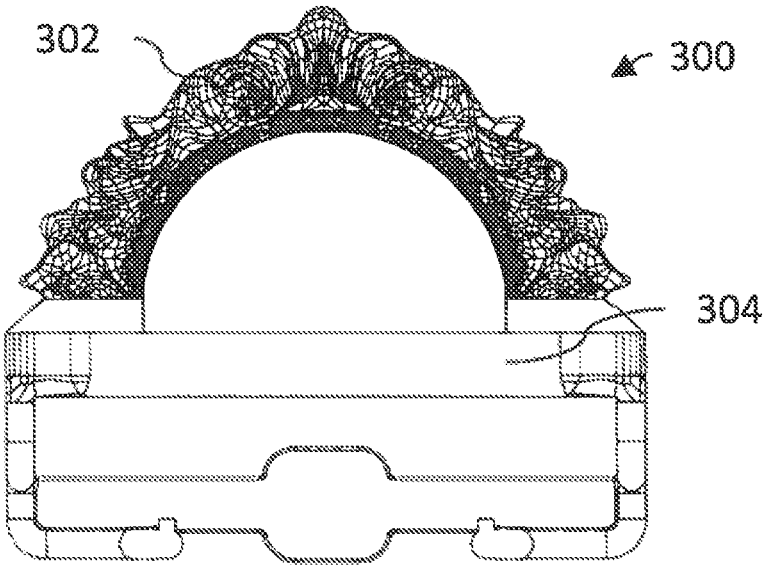
Figure 3C:
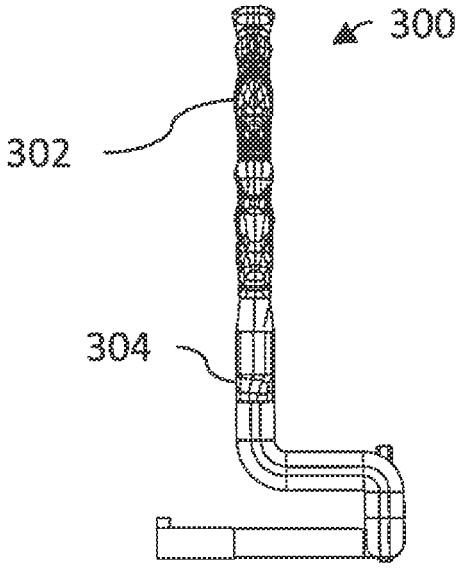
Figure 3D:
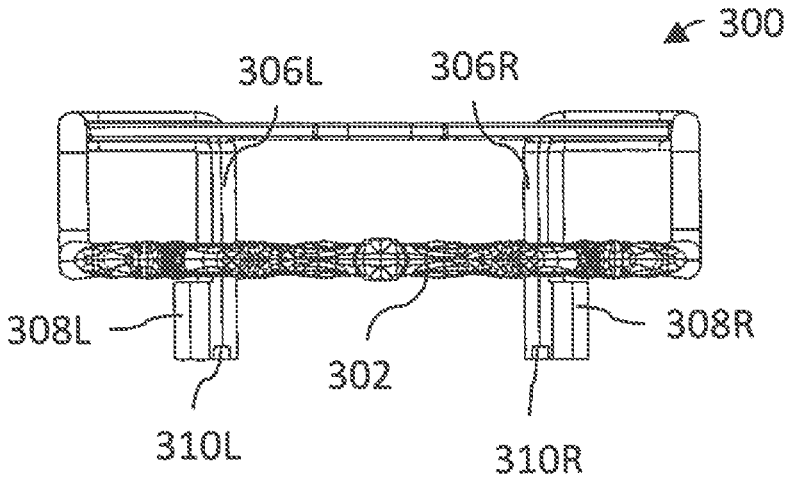
Figure 3E:
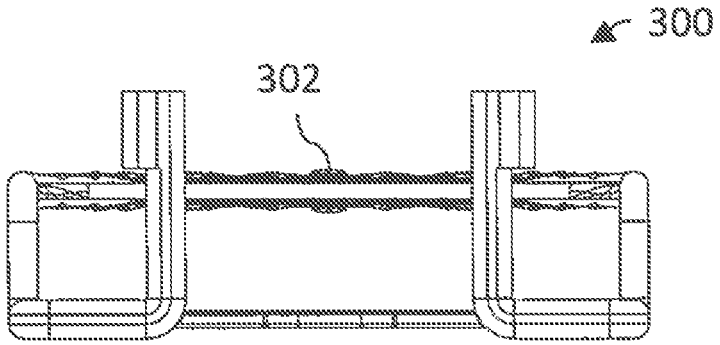

The present invention will now be described by referencing the appended figures representing preferred embodiments. FIG. 1A depicts a perspective view of one example of a soap dish 100 of an adjustable upright standing soap hosting device (the "device") according to various embodiments of the present invention. In preferred embodiments, the elements of the device are configured with two supports (i.e. a front support 200 and a rear support 300) with a front holder 202 on the front support 200 which serves as a holder for the soap and a bar 304 on the back support 300 which prevents the soap from falling off the back of the device. The front holder 202 has a top aperture 204 with four sides, specifically a top aperture front side 204F, a top aperture right side 204R, a top aperture bottom side 204B, and a top aperture left side 204L. The front bracket 202 holds the soap and prevents it from sliding out on the sides and touching the soap dish 100. The top aperture front side 204F is an arch and is connected at the left bottom of the arch to the front of the top aperture left side 204L and connected at the right bottom of the arch to the front of the top aperture right side 204R. The top aperture 204 is attached to the front support 200 and attaches to the soap dish 100. The back support 300 has flexible sliding arms 306L and 306R that slides in apertures 206L and 206R of the bracket 204 on the front arm 200 and can be adjusted based on the depth of the soap. Therefore as the soap shrinks in size because of usage, the device will still secure it. The dip 104 in the soap dish 100 keeps the water from touching the soap. This will allow the soap to dry and allow the soap dish 100 to catch the water dripping off of the soap. The soap dish has a left stanchion 102L and a right stanchion 102R. The soap dish has a rim 106.

As perhaps best shown in FIGS. 3A, 3B, 3C, 3D and 3E the back support (300) is configured with a bar 304 across the back to secure the soap and sliding arms (i.e. left sliding arm 306L and right sliding arm 306R) that allow the device to be adjusted in depth by pushing into the apertures 206L and 206R on the front support 200. Where the left sliding arm 306L has an appendage 308L and a tab 310L There is a left square opening 210L above the bottom left aperture 206L, with a left-side front edge, a left-side right edge, a left-side left edge and a left-side back edge 208L. There is a square opening 206R above a bottom right aperture (not shown but a mirror of the symmetric to the bottom left aperture), where the right side square opening has a right-side front edge, a right-side right edge, a right-side left edge and a right-side back edge 208R.

FIGS. 3A, 3B, 3C, 3D and 3E depicts various angles of the back support 300 which attaches to the front support 200. The back and front support 300 and 200 attach to the soap dish/case 100. The soap sits on the apparatus.

While preferred materials for elements have been described, the device is not limited by these materials. Wood, plastics, rubber, foam, metal alloys, aluminum, and other materials may comprise some or all of the elements of the soap hosting dish/case positioning devices and apparatuses in various embodiments of the present invention.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. An upright standing soap hosting device for holding handmade shaped soap in a standing position comprising:

a soap dish with a dip and a left stanchion extending up from the dip and a right stanchion extending up from the dip;

a front support that attaches to a top of the left stanchion and to a top of the right stanchion, the front support has a top aperture with a front side, a bottom side, a left side and a right side, and under the top aperture a left bottom aperture runs front to back and forms a valley that opens to the right and a right bottom aperture runs front to back and forms a valley that opens to the left; and a back support with a bracket attached having a horizontal bar that goes from left to right, the back support having a left arm that can fit in the left bottom aperture and the back support having a right arm that can fit in the right bottom aperture, where the left arm slides inside the left bottom aperture and the right arm slides inside the right bottom aperture, and the top aperture and the horizontal bar form a boxed in area that can accept a standing piece of soap.

2. The upright standing soap hosting device of claim 1 where the left arm has a left appendage extending to the left, and the right arm has a right appendage extending to the right where the left appendage fits inside the left bottom aperture and the right appendage fits inside the right bottom aperture.

3. The upright standing soap hosting device of claim 2 where the left arm has a left tab extending upward, and where the front support has a left opening above the left bottom aperture with a left back edge, and the left tab extends into the left opening and the back support is prevented from sliding out of the front support by the left tab hitting the left back edge, in addition the right arm has a right tab extending upward, and where the front support has a right opening above the right bottom aperture with a right back edge, and the right tab extends into the right opening and the back support is prevented from sliding out of the front support by the right tab hitting the right back edge.

4. The upright standing soap hosting device of claim 1 where the left arm has a left tab extending upward, and where the front support has a left opening above the left bottom aperture with a left back edge, and the left tab extends into the left opening and the back support is prevented from sliding out of the front support by the left tab hitting the left back edge, in addition the right arm has a right tab extending upward, and where the front support has a right opening above the right bottom aperture with a right back edge, and the right tab extends into the right opening and the back support is prevented from sliding out of the front support by the right tab hitting the right back edge.

5. The upright standing soap hosting device of claim 1 where the left stanchion and right stanchion attach to a bottom of the front support.

6. The upright standing soap hosting device of claim 1 where the soap dish is oval shaped.

7. The upright standing soap hosting device of claim 1 where the soap dish has legs on a bottom.

8. The upright standing soap hosting device of claim 7 where the legs extend below the dip so the soap dish is support on the legs.

9. An upright standing soap hosting device for holding handmade shaped soap in a standing position comprising:

a soap dish with at least one stanchion extending up;

a front support that attaches to the at least one stanchion, the front support has a top aperture with a front side, a bottom side, a left side and a right side, and under the top aperture a bottom aperture that runs from front to back; and a back support with a bracket attached having a horizontal bar that goes from left to right, the back support having an arm that slides into the bottom aperture, where and the top aperture and the bar form a boxed in area that can accept a standing piece of soap and the arm slides into the bottom aperture and to allow the boxed in area to become narrower to accept soap as it shrinks in size from use.

10. The upright standing soap hosting device of claim 9 where the arm has a appendage extending horizontally, where the appendage fits inside the bottom aperture.

11. The upright standing soap hosting device of claim 10 where the arm has a tab extending upward, and where the front support has a opening above the bottom aperture with a back edge, and the tab extends into the opening and the back support is prevented from sliding out of the front support by the tab hitting the back edge.

12. The upright standing soap hosting device of claim 9 where the arm has a tab extending upward, and where the front support has an opening above the bottom aperture with a back edge, and the tab extends into the opening and the back support is prevented from sliding out of the front support by the tab hitting the back edge.

13. The upright standing soap hosting device of claim 9 where the at least one stanchion attaches to a bottom of the front support.

14. The upright standing soap hosting device of claim 9 where the soap dish is oval shaped.

15. The upright standing soap hosting device of claim 9 where the soap dish has legs on a bottom.

16. The upright standing soap hosting device of claim 15 where the legs extend below the dish so the soap dish is support on the legs.

17. An upright standing soap hosting device for holding handmade shaped soap in a standing position comprising:

a soap dish with a dip and a left stanchion extending up from the dip and a right stanchion extending up from the dip;

a front support that attaches to the top of the left stanchion and to a top of the right stanchion, the front support has a top aperture with a front side, a bottom side, a left side and a right side, and under the top aperture a left bottom aperture runs front to back and forms a valley that opens to the right and a right bottom aperture runs front to back and forms a valley that opens to the left; and a back support with a bracket attached having a horizontal bar that goes from left to right, the back support having a left arm that can fit in the left bottom aperture and the back support having a right arm that can fit in the right bottom aperture, where the left arm slides inside the left bottom aperture and the right arm slides inside the right bottom aperture, and the top aperture and the horizontal bar form a boxed in area that can accept a standing piece of soap, where the left arm has a left appendage extending to the left, and the right arm has a right appendage extending to the right where the left appendage fits inside the left bottom aperture and the right appendage fits inside the right bottom aperture, where the left arm has a left tab extending upward, and where the front support has a left opening above the left bottom aperture with a left back edge, and the left tab extends into the left opening and the back support is prevented from sliding out of the front support by the left tab hitting the left back edge, in addition the right arm has a right tab extending upward, and the front support has a right opening above the right bottom aperture with a right back edge, and the right tab extends into the right opening and the back support is prevented from sliding out of the front support by the right tab hitting the right back edge, where the left stanchion and right stanchion attach to the bottom of the front support, and where the soap dish is oval shaped, and has legs on the bottom that extend below the dip so the soap dish is supported on the legs.

* * * * *